US010342344B1

(12) United States Patent
Waas et al.

(10) Patent No.: US 10,342,344 B1
(45) Date of Patent: Jul. 9, 2019

(54) REFRIGERATION DRAWER ORGANIZATION INSERT

(71) Applicant: Prince Castle LLC, Carol Stream, IL (US)

(72) Inventors: Zach Waas, Lombard, IL (US); David A. Schneberger, Plymouth, MN (US)

(73) Assignee: Prince Castle LLC, Carol Stream, IL (US)

( * ) Notice: Subject to any disclaimer, the term of this patent is extended or adjusted under 35 U.S.C. 154(b) by 0 days.

(21) Appl. No.: 15/976,365

(22) Filed: May 10, 2018

(51) Int. Cl.
*F25D 25/02* (2006.01)
*A47B 88/994* (2017.01)
*A47B 88/969* (2017.01)

(52) U.S. Cl.
CPC ..... *A47B 88/994* (2017.01); *F25D 25/025* (2013.01); *A47B 2088/976* (2017.01)

(58) Field of Classification Search
CPC ..... A47B 88/00; A47B 88/90; A47B 88/994; A47B 88/969; A47B 88/988; A47B 88/975; A47B 2088/976; F25D 25/005; F25D 25/025; F25D 2325/021; F25D 2331/812
See application file for complete search history.

(56) References Cited

U.S. PATENT DOCUMENTS

| | | | | |
|---|---|---|---|---|
| 2,425,232 A | | 8/1947 | Earle | |
| 5,692,431 A | * | 12/1997 | Herring | A21B 3/133 220/23.2 |
| 6,938,784 B2 | * | 9/2005 | Yang | A47B 88/00 211/87.01 |
| 7,028,503 B2 | * | 4/2006 | Lyvers | F25C 5/18 312/334.7 |
| 8,100,486 B2 | | 1/2012 | Veltrop | |
| 2007/0084234 A1 | * | 4/2007 | Park | F25D 21/04 62/407 |
| 2011/0048059 A1 | * | 3/2011 | Song | F25D 19/006 62/449 |
| 2011/0127896 A1 | | 6/2011 | Andeson et al. | |
| 2011/0309732 A1 | | 12/2011 | Horil et al. | |
| 2017/0131016 A1 | | 5/2017 | Eicher et al. | |

FOREIGN PATENT DOCUMENTS

| | | | | |
|---|---|---|---|---|
| DE | 20006296 U1 | * | 7/2000 | A47B 77/18 |
| DE | 202010000629 U1 | * | 5/2011 | A47B 77/18 |
| EP | 2549218 A2 | * | 1/2013 | A47B 73/008 |
| EP | 3037763 A1 | * | 6/2016 | F25D 25/025 |
| FR | 2266475 A1 | * | 10/1975 | B65D 25/06 |
| JP | 2003130523 A | * | 5/2003 | |
| JP | 2017029202 A | * | 2/2017 | |
| WO | WO-2011160973 A1 | * | 12/2011 | F25D 25/005 |
| WO | WO-2017152955 A1 | * | 9/2017 | F25D 25/025 |

* cited by examiner

*Primary Examiner* — Andrew M Roersma
(74) *Attorney, Agent, or Firm* — Andrus Intellectual Property Law, LLP

(57) ABSTRACT

A refrigeration apparatus includes a drawer frame with a front wall, a rear wall, and opposed side walls. A door is secured to the front wall of the drawer frame. A divider extends across the drawer frame between the front wall and the rear wall. A refrigeration storage insert includes opposed depending walls connected by a bottom surface and support flanges extend away from the opposed depending walls. The refrigeration storage insert removably engages the opposed side walls of the drawer frame respectively with the support flanges and the depending walls extend interior of the drawer frame such that the bottom surface is supported at a position below the divider.

21 Claims, 5 Drawing Sheets

REFRIGERATION DRAWER ORGANIZATION INSERT

BACKGROUND

The present disclosure is related to the field of refrigeration. More particularly, the present disclosure relates to organization of drawers in a refrigeration compartment of a refrigeration compartment of a refrigeration apparatus.

In the restaurant and food services industries, kitchen space can be valued at a premium. In doing so, solutions to improve useable space of refrigeration units are desired. Furthermore, there can be many types of food preparation stations within a kitchen space. Food preparation stations may include grills or broilers, fresh produce slicing stations, and/or sandwich assembly stations. Therefore, refrigeration systems in general must be made in a variety of sizes and configuration in order to adequately provide the reduced temperature holding needs of the kitchen while also conforming to available space in proximity to the station in which the food is used.

Under table or under counter refrigeration systems can be an attractive use of space in a kitchen. However, such arrangements may present challenges for worker access to the food products stored in such a refrigeration unit. Therefore, refrigeration units with one or more drawers within the refrigeration compartment can provide improved worker access to a greater volume of refrigeration compartment within which food may be stored. Additionally, food that has undergone some amount of pre-processing, for example slicing of fresh produce is typically held within a food service tray. Food service trays are generally of regularly sizes and dimensions and used within the food service industry. Such food service trays may be referenced as being "full pan" which may roughly measure 12 inches by 20 inches. Based upon such a general pan size definition, other pans may be made to relative fractional sizes of a full pan, for example a "one half pan", a "one third pan", and a "one sixth pan" sizes. Such pans are often our inches deep, while other pans may be have the same length and width dimensions but may have other pan depths. It is recognized that these pan dimensions are merely exemplary and that other pan dimensions may be used in other settings.

In use, a worker may fill an associated pan with the produce either for cooking, sandwich assembly, or with whole or sliced produce. The kitchen may have selected a particular pan size for a particular food based upon relative usage requirements. These pans of food may be stored in drawers of refrigeration units until the entire pan is removed from the refrigeration unit for use at a cooking station or individual portions of food may be retrieved from pan and the refrigeration unit closed to maintain a desired holding environment about the remaining food items. Various embodiments of refrigeration apparatus have tried to improve the accessibility and/or operational capacity of refrigeration units, yet there is still further desirability for systems that enable flexible use and storage of a variety of foods and food containers within a refrigeration unit, particularly in a manner that tallows such flexibility but permits the organized storage of food service style storage pans.

BRIEF DISCLOSURE

An exemplary embodiment of a refrigeration apparatus includes a refrigeration cabinet. The refrigeration apparatus is configured to control an environmental condition within the refrigeration cabinet. A drawer frame includes a front wall, a rear wall, and opposed side walls. A door is secured to the front wall of the drawer frame. A divider extends across the door frame between the front wall and the rear wall. A refrigeration storage insert includes opposed depending walls connected by a bottom surface. Support flanges extend away from the opposed depending walls. The refrigeration storage insert removably engages the opposed side walls of the drawer frame respectively with the support flanges. The depending walls extend interior of the drawer frame such that the bottom surface is supported at a position below the divider.

In exemplary embodiments of refrigeration apparatus, a pair of fixed rails are secured to the interior of the refrigeration cabinet. At least one pair of movable rails are secured to the opposed side walls of the drawer frame. At least one pair of removable rails further include inwardly extending support brackets and the inwardly extending support brackets are secured to the respective bottom ends of the opposed side walls. The opposed depending walls of the refrigeration storage insert extend through the drawer frame past the at least one pair of moveable rails. The bottom surface is location at a position below the at least one pair of moveable rails.

In still further exemplary embodiments, a front frame ledge extends interior of the drawer frame from the front wall. The front frame ledge includes a plurality of divider apertures. A rear frame ledge extends interior of the drawer frame form the rear wall. The rear frame ledge includes a plurality of divider apertures. In an embodiment, a plurality of dividers removably extend across the drawer frame between the divider support aperture of the front wall and the divider support apertures of the rear wall. Still further embodiments include side frame ledges that extend interior of the drawer frame from the opposed side walls. The support flanges of the refrigeration storage insert engage the side frame ledges. The refrigeration storage insert may further include downwardly depending lips that extend from the support flanges. In an exemplary embodiment, the support flanges engage the side frame ledges and the downwardly depending lips engage respective exterior surfaces of the opposed side walls. In an exemplary embodiment, the support flanges engage the opposed side walls. The support flanges are co-planar with the front frame ledge and the rear frame ledge.

In still further exemplarily embodiments, the opposed depending walls of the refrigeration storage insert extend below the walls of the drawer frame and the bottom surface is located at a position below a bottom surface of the support frame. In an exemplary embodiment, the refrigeration storage insert removably engages the drawer frame free from engagement with the front wall and a back wall of the drawer frame. In an exemplary embodiment, at least one storage pan is removably supported by the drawer frame by engagement of the at least one storage pan with at least the front wall and the rear wall at a positon suspended above the bottom surface. In an exemplary embodiment, the bottom surface supports a second storage pan at a position below a the at least one storage pan. The at least one storage pan is removably supported by the drawer frame free from engagement with the at least one storage pan with refrigeration storage insert. The at least one storage pan is further removably supported by engagement with the divider and at least one of the support flanges of the refrigeration storage insert.

In still further exemplary embodiments, the refrigeration storage insert is constructed of a single piece of sheet metal. In exemplary embodiments, the refrigeration apparatus further includes a front ridge extending along a front edge of the bottom surface between the depending walls and a back ridge extending along a back edge of the bottom surface between the depending walls. In an exemplary embodiment, the front ridge extends along front edges of the depending walls and the back ridge extends along back edges of the depending walls. The front ridge and the back ridge terminate at a position below a bottom of the drawer frame.

DETAILED DISCLOSURE

Figure 1:
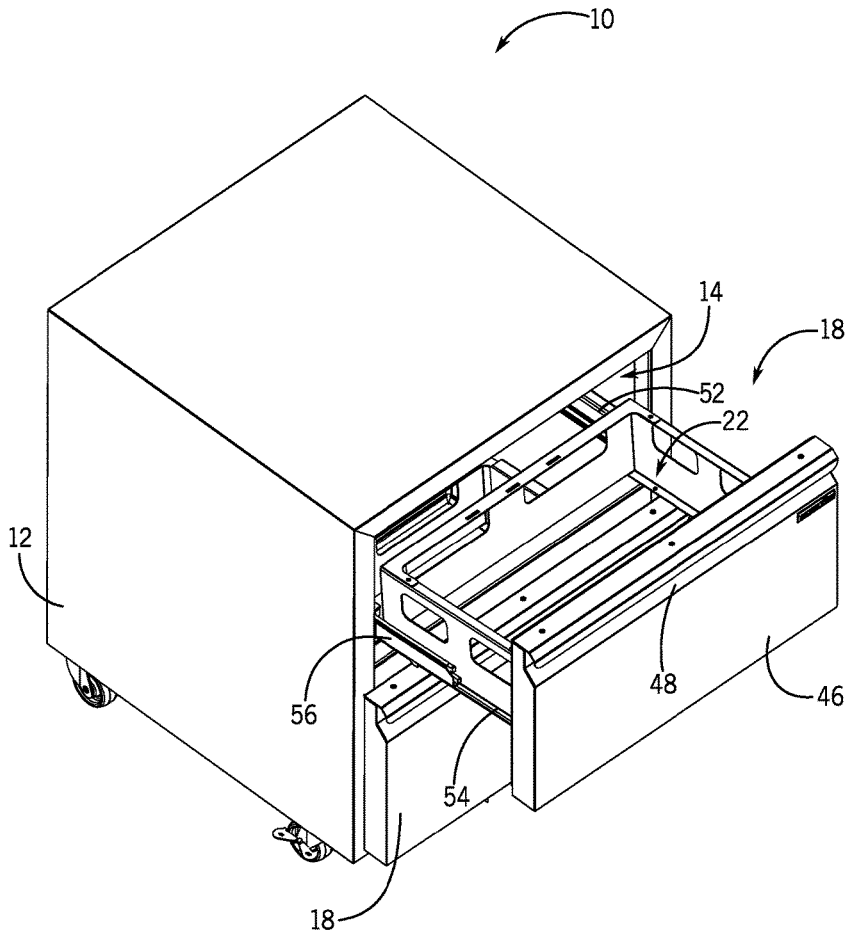
FIG. 1 is a perspective view of an under counter refrigeration apparatus.

FIG. 1 depicts an exemplary embodiment of a refrigeration apparatus 10. The refrigeration apparatus 10 is exemplarily an under counter refrigeration apparatus. It will be recognized that in exemplary embodiments, refrigeration apparatuses may be freezers, or refrigerators or a combination of both. The refrigeration apparatus includes a cabinet 12 that defines a compartment 14. The refrigeration apparatus 10 operates to control the environment within the compartment 14 of the cabinet 12. In exemplary embodiments, the environment within the compartment 14 is controlled for temperature and/or humidity.

Figure 2:
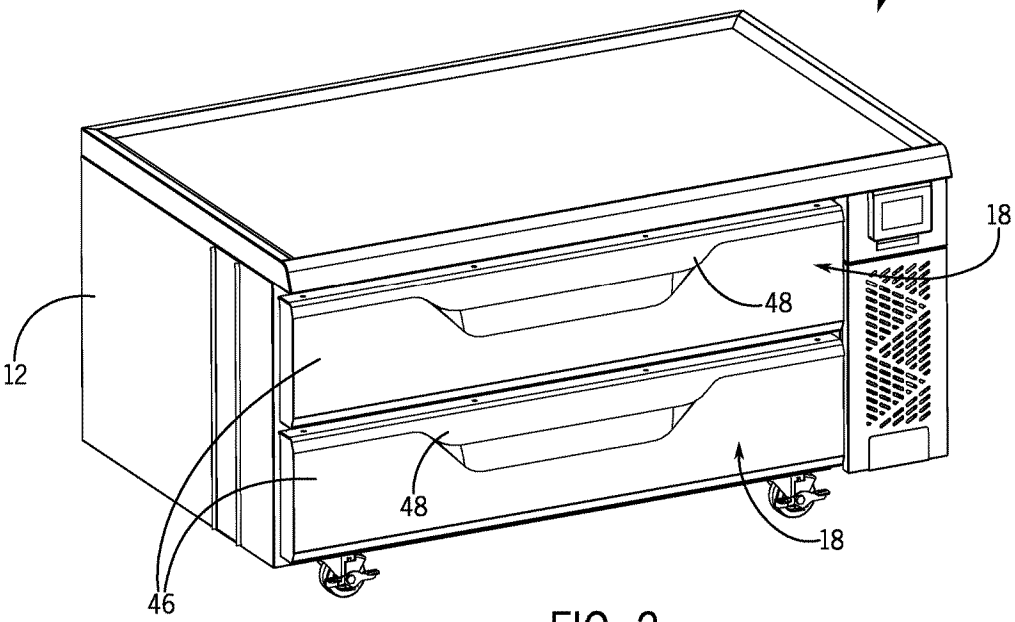
FIG. 2 is a perspective view of a prep table refrigeration apparatus.

FIG. 2 depicts an exemplary embodiment of a refrigeration apparatus 10 in a configuration as a prep table refrigeration apparatus. It will be recognized that other exemplary and non-limiting embodiments of refrigeration apparatus include pizza prep tables, chef base prep tables, and upright refrigerators and/or freezers. It will be recognized that there refrigeration devices are merely exemplary and other refrigeration devices will be recognized by a person of ordinary skill in the art in view of the present disclosure.

Figure 4:
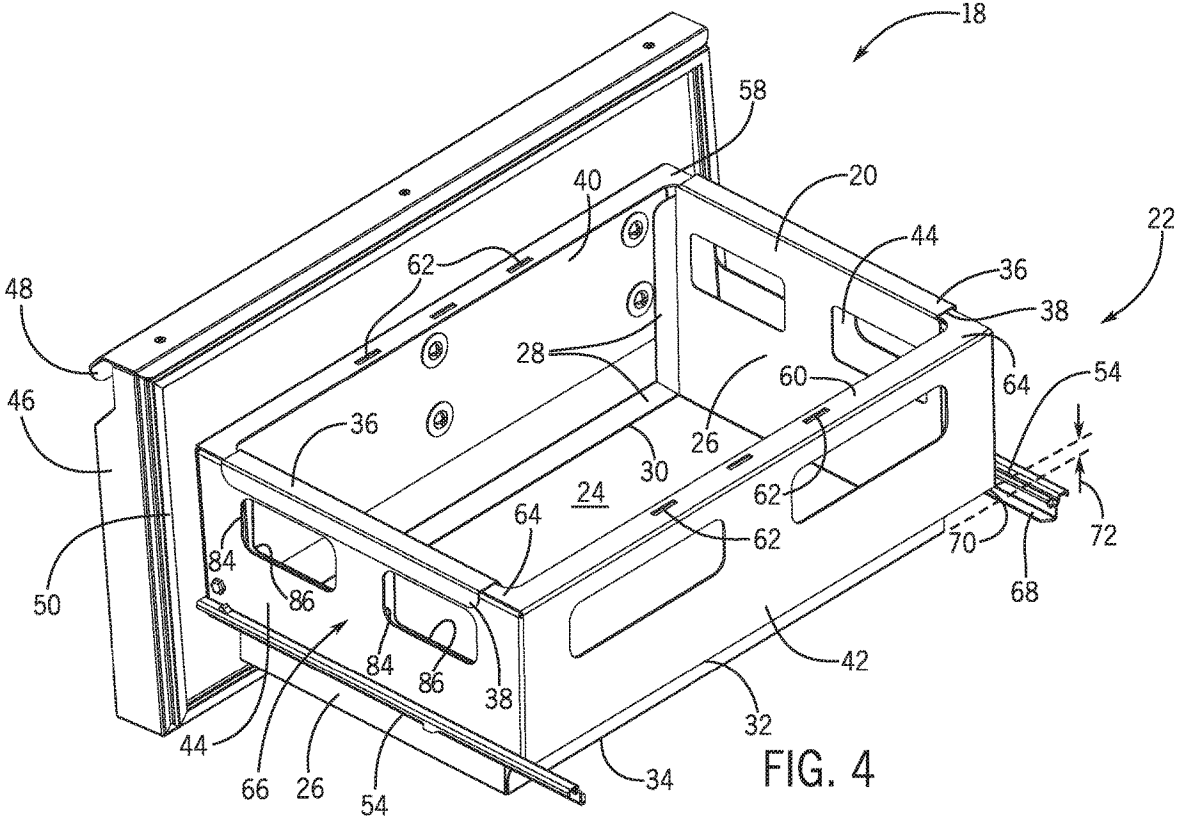
FIG. 4 is a perspective view of a drawer with a refrigeration storage insert.

FIG. 4 is a perspective view of a drawer 18 for a refrigeration apparatus 10. Particularly, it will be recognized that the refrigeration apparatus 10 includes at least one drawer 18. Drawers 18 can be an efficient way to promote access to the volume of the compartment 14, particularly when the drawer 18 is located at or below the waist of a worker. However, improved organization solutions for such drawers 18 of refrigeration apparatus 10 are desired to promote adaptability and maximization of use of the refrigerated volume of the compartment 14. Exemplary embodiments described herein include a refrigeration storage insert 20 that is removably connected to a frame 22 of the drawer 18.

The drawer 18 includes a frame 22. The frame 22 is exemplarily constructed of a front wall 40 and a rear wall 42 opposite the front wall 40 opposed side walls 44 extend between the respective front wall 40 and the rear wall 42. The front wall 40 is secured to a door 46 which exemplary includes a handle 48. The door 46, while not depicted, is exemplarily filled with an insulative material, for example polyurethane foam, however, such insulated material may often be encapsulated in a thin sheet metal housing, for example, constructed of stainless steel. The door 46 further includes gaskets 50 and/or other engagement apparatus for providing a seal with the cabinet 12 when the drawer 18 is in a closed position, such as to isolate the environment within the compartment 14.

In an embodiment, the drawer 18 may be configured so as to be operable to withdraw the drawer 18 to an extent such that the rear wall 42 is positioned at the extent of the cabinet 12. However, it will be recognized that in other embodiments, the drawer 18 may withdraw from the compartment 14 more or less than this amount.

The drawer 18 exemplarily uses a system of sliding rails to facilitate the opening and closing the drawer 18. In a merely exemplary embodiment of a rail system, at least a fixed rail 52 is secured to the cabinet 12 within the compartment 14. A movable rail 54 is secured to the frame 22. It will be recognized that the so called movable rail 54, while it may be rigidly secured to the frame 22, the movable rail (along with the frame 22 and the drawer 18) moves relative to the fixed rail 52. It will be recognized that embodiments of refrigeration apparatus 10 exemplarily include a pair of fixed rails 52 and movable rails 54 adapted to oppose sides of the drawer 18 and that work in conjunction to convey the drawer 18 between the open and closed positions. It will also be recognized that in exemplary embodiments an intermediate rail 56 may be positioned between the fixed rail 52 an the movable rail 54 in such embodiments, an intermediate rail 56 may facilitate lengthening the draw length of the drawer while reducing the lengths of the fixed rail 52 and moveable rail 54 to better fit within the compartment 14.

Figure 3:
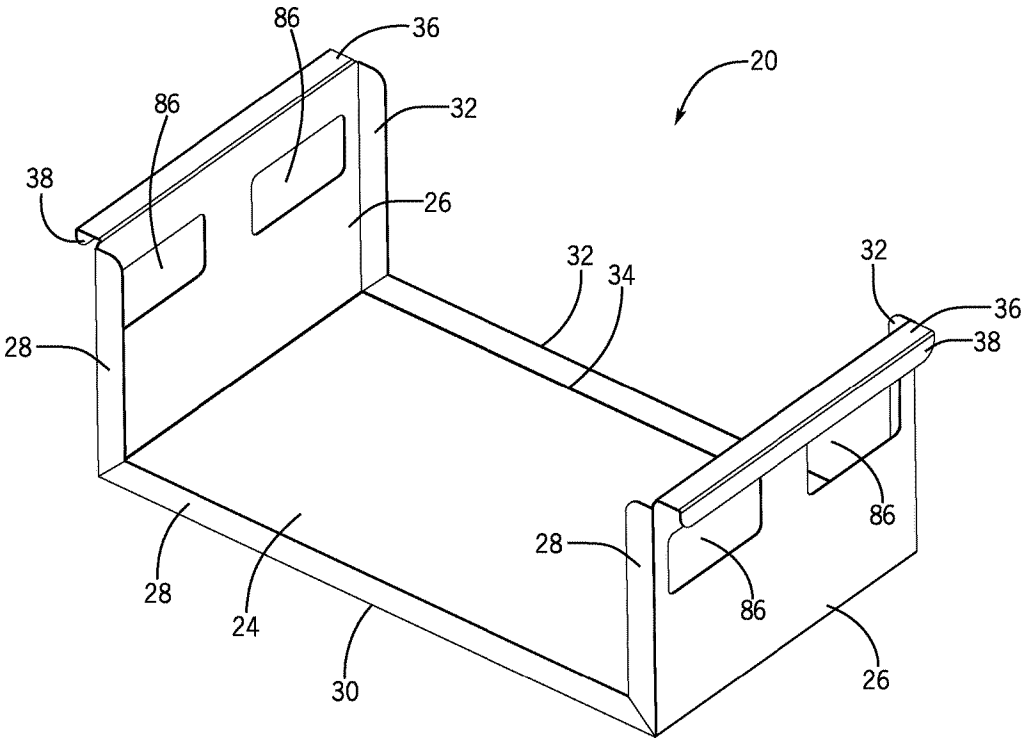
FIG. 3 is a perspective view of a refrigeration storage insert.

FIG. 3 is a perspective view of an exemplary embodiment of a refrigeration storage insert 20. The refrigeration storage insert 20 includes a bottom surface 24. The bottom surface 24 extends between two opposed depending side walls 26. A front ridge 28 extends along a front edge 30 of the bottom surface. A back ridge 32 extends along a back edge 34 of the bottom surface 24. The front edge 30 and the back edge 34 both extend upwards away from the bottom surface 24. In exemplary embodiments, the respective front ridge 28 and the back ridge 32 may also extend up along the respective front and back edges of the opposed depending side walls 26. The top ends of the opposed depending side walls 26 include support flanges 36 which extend away from the opposed depending side walls 26 and extend exterior in a direction away from the bottom surface 24. A lip 38 is located at the outermost extent of the support flanges 36. The lip 38 extends downwardly in a direction that may exemplarily be parallel to the opposed depending side walls 26.

FIG. 4 is a perspective view of an exemplary embodiment of a drawer 18 with a refrigeration storage insert 20. As shown herein, the refrigeration storage insert 20 engages the side walls 44 of the frame 22 such that the refrigeration storage insert 20 is supported by the frame 22 within the drawer 18. The front wall 40 of the frame 22 and the rear wall 42 of the frame 22 further respectively include a front frame ledge 58 and a rear frame ledge 60. As will be described in further detail herein, the front frame ledge 58 and the rear frame ledge 60 respectively each include at least one divider aperture 62 while in exemplary embodiments including that depicted in FIG. 4, each of the front frame ledge 58 and rear frame ledge 60 include a plurality of divider apertures 62. The divider apertures 62 exemplarily extend through the front frame ledge 58 and the rear frame ledge 60.

In an exemplary embodiment, when the support flange 36 of the refrigeration storage insert 20 engages the respective opposed side walls 44, the support flange 36 is held in a position that is co-planar with the front frame ledge 58 an the rear frame ledge 60. In anther exemplary embodiment, the opposed side walls 44, of the frame 22, each further include side frame ledges 64 which extend interior of the frame 22 from the respective opposed side walls 44. In such an embodiment, the support flanges 36 may engage the side frame ledges 64 and further may be dimensioned such as to be commensurate in size with the side frame ledges 64. In one exemplary embodiment, the side frame ledges 64 may be coplanar with the front frame ledge 58 and the rear frame ledge 60 and thus the support flange 36 rests at a position above the front frame ledge 58 and the rear frame ledge 60, while in another exemplary embodiment, the side frame ledges 64 may be positioned slightly below one or both of the front frame ledge 58 an the rear frame ledge 60 such that when the support flanges 36 engage the side frame ledges 64 that the support flanges 36 are co-planar with one or both of the front frame ledge 58 and the rear frame ledge 60.

As further depicted in FIG. 4, the lip 38 extends downwardly from the support flange 36 and in an embodiment the lip 38 engages an exterior surface 66 of the opposed side walls 44. In a still further exemplary embodiment, the opposed depending side walls 26 may extend in a plane parallel to the lips 38 and the opposed depending side walls 26 may engage interior surface (not depicted) of the opposed side walls 44. In an exemplary embodiment, the opposed side walls 44 may be a single piece of metal and the interior and exterior surface of the side wall are the surfaces there. In another embodiment, the opposed side walls 44 may be constructed of two spaced apart surfaces (not depicted) and, for example, depending from interior edges of the side frame ledges 64.

Similarly, the front wall 40 and the rear wall 42 may exemplarily include interior surfaces that depend from an interior edge of the respective front frame ledge 58 and rear frame ledge 60. In such exemplary embodiments, the portion of the front ridge 28 that extends from the depending side walls 26 may engage this interior surface (not depicted) of the front wall 40 while the portions of the back ridges 32 extending from the opposed depending side walls 26 may similarly engage an interior surface (not depicted) of the rear wall 42.

Therefore, in such arrangements as described herein, the refrigeration storage insert 20 may exemplarily be received within the frame 22 and supported by the frame 22 in a manner in which the refrigeration storage insert 20 is free from engagement with the front wall 40 and from the rear wall 42. In a still further exemplary embodiment, the refrigeration storage insert 20 may be received and supported within the frame 22 in a manner in which the refrigeration storage insert 20 is free from engagement with the front frame ledge 58 and the rear frame ledge 60. Such features and functions will be discussed in further detail herein.

FIG. 4 further depicts the moveable rail 54 secured to the frame 22 of the drawer 18. The rails 54 exemplarily include a support bracket 68 the support bracket 58 exemplarily engages respective bottoms 70 of the opposed side walls 44. In this manner, the support bracket 68 receives the weight of the drawer 18 onto the movable rails 54 for moveable engagement with the refrigeration apparatus (not depicted). In still further exemplary embodiments, the rails 54 additionally engage the exterior surfaces 66 of the opposed side walls 44. In an example, the support bracket 68 may be perpendicular to the portion of the rail 54 that engages the exterior surfaces 66 of the opposed side walls 44. Combined engagement between the rails 54 and the frame 22 can help to securely retain the frame 22 in engagement with the rails 54.

In exemplary embodiments, the opposed depending side walls 26 of the refrigeration storage insert 20 extends through the frame 22 to a position below the bottoms 70 of the side walls 44, but also as the bottoms of the front wall 40 and rear wall 42. In such embodiments, the bottom surface 24 therefore is secured at a position below the side walls of the frame 22. In an additional embodiment, as noted above, the front ridge 28 and the back ridge 32 extend upwardly from the bottom surface 24 and in an embodiment, a gap 72 extends a distance between a top of the respective front ridge 28 and the back ridge 32 and the bottoms 70 of the walls of the frame 22. In embodiments the side walls 44 of the frame 22 include apertures 84. These apertures 84 promote airflow through the frame 22 for exemplary use in a forced air refrigeration system. The depending side walls 26 of the refrigeration storage insert 20 may also include apertures 86. The apertures 86 are positioned within the side walls to align with the apertures 84 of the frame 22, when the refrigeration storage insert 20 is engaged with the frame 22. The apertures 86 may be dimensioned to match the dimensions of the apertures 84. This further enables airflow to the interior of the frame 22 when used with the refrigeration storage insert 20.

Figure 5B:
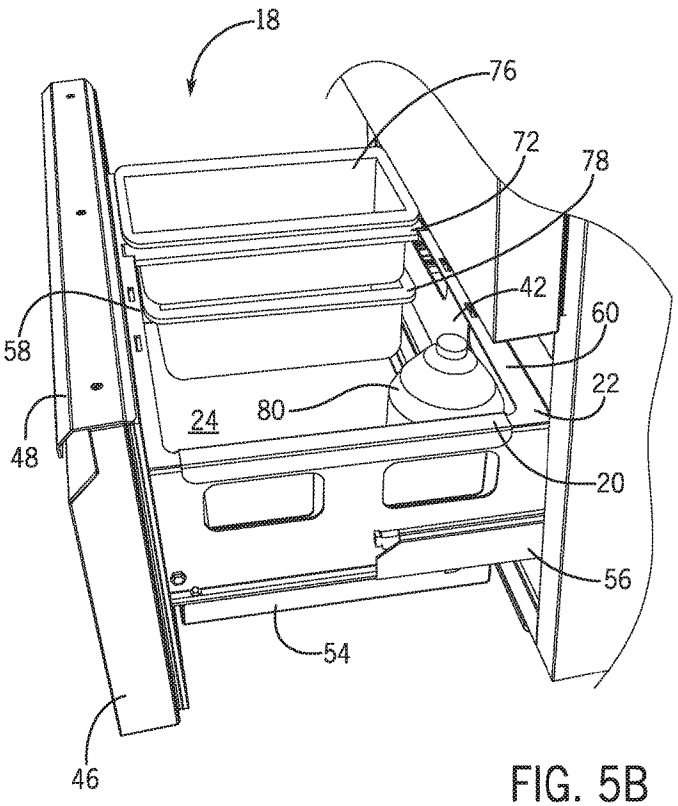
FIGS. 5A and 5B depict exemplary embodiments of a refrigeration apparatus in use.
Figure 5A:
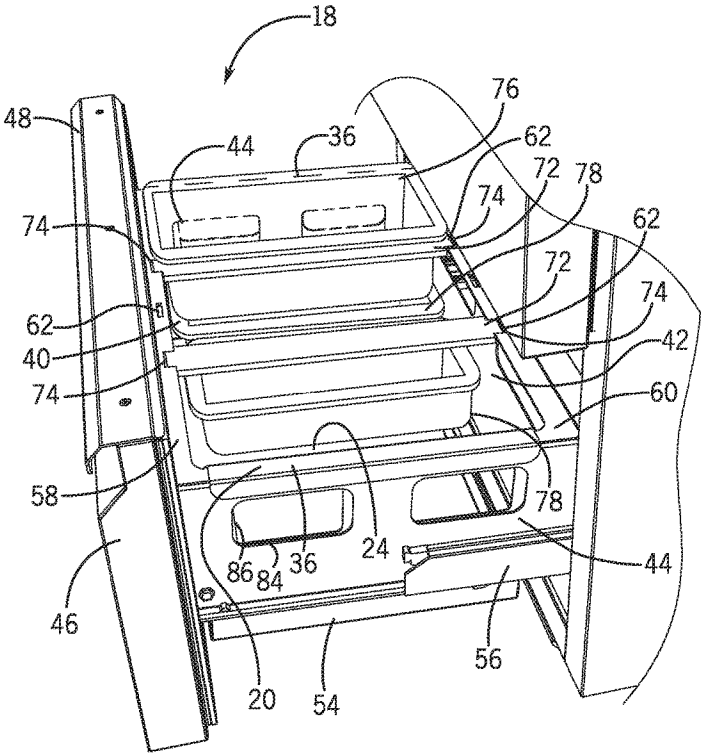

FIGS. 5A and 5B depict exemplary embodiments of refrigeration apparatus in which refrigeration storage inserts 20 are used. Divider 72 extends between the front frame ledge 58 and the rear frame ledge 60. In an exemplary embodiment, the dividers 72 include downwardly depending tabs 74 which are inserted into the divider apertures 62 to secure the dividers 72 to the frame 22. A combination of the front frame ledge 58, rear frame ledge 60, and at least one divider 72 supports a food storage pan 76 within the drawer 18. It will be recognized that the food storage pans 76 may be any of a variety of shapes and sizes, although here is a commonly used standardized size system for food storage pans. In such an exemplary embodiment, a "full size pan" is exemplarily 12 inches by 20 inches. In embodiments, denominations of such a full size pan may be used which may be accordingly denoted as "half size pans", "third sized pans", "one sixth sized pans", "one ninth sized pans", or "one quarter sized pans". While these examples are given herein, it will be recognized that other sizes, shapes, and dimensions of storage pans may be used with other embodiments. As noted above, the drawer 18 includes at least one divider 72 and in exemplary embodiments a plurality of dividers as depicted in FIG. 5A. It will be recognized that the divider aperture 62 may be spaced along the respective front frame ledge 58 and rear frame ledge 60 at locations that represent one or more of the above noted standard storage pan dimensions.

As depicted in FIG. 5A the refrigeration storage insert 20 is secured to the frame 22 in a manner that does not obstruct the placement of the food storage pan 76 in engagement with a front frame ledge 58, rear frame ledge 60, and a divider 72 while an additional food storage pan 78 is supported by the bottom surface 24 at a position below the first food storage pan. In this manner, the drawer 18 and frame 22 typically used in a drawer of the refrigeration apparatus can be supplemented by the refrigeration storage insert 20 for additional drawer storage space without interference, support, or engagement with the front frame ledge 58, the rear frame ledge 60, or any dividers 72. The refrigeration storage insert 20 also operates without interfering with the support and engagement of the food storage pan 76 with the frame 22. As depicted in FIGS. 5A and 5B, the additional food storage pan 78 can be supported by the bottom surface 24 of the refrigeration storage insert 20, while the food storage pan 76 is supported above it by engagement with some or all of the front frame ledge 58, the rear frame ledge 60, a divider 72 and the support flange 36 of the refrigeration storage insert. The additional storage space provided by the bottom surface 24 provides space for any number of types of containers for food, including, but not limited to storage pans 78 as depicted in FIG. 5A, but also pre-packaged meat or bags of fresh or frozen produce.

As depicted in FIG. 5B, the refrigeration storage insert 20 can further be used to provide flexibility in the storage space accommodated by the drawer 18 in a manner such that the drawer 18 may include both food storage pans 76 as well as larger containers or food items for example liquid container 80 which extends vertically larger than the receptive walls of the frame 22. Such a container being accommodated within the space provided by the drawer 18 due to the fact that the refrigeration storage insert 20 and more particularly the opposed depending side walls 26 and the bottom surface 24 of the refrigeration storage insert 20 extend to a position below the bottom of the walls of the frame 22. The refrigeration storage insert 20 also extends to a position below the rails 54. This combination can enable more efficient use of the volume of the compartment 14 of the refrigeration apparatus 10 to accommodate additional storage capacity.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A refrigeration apparatus comprising:
- a refrigeration cabinet, wherein the refrigeration apparatus is configured to control an environmental condition within the refrigeration cabinet;
- a drawer frame comprising a front wall, a rear wall, and opposed side walls;
- a door secured to the front wall of the drawer frame;
- a divider extending across the drawer frame and secured to the front wall and the rear wall; and
- a refrigeration storage insert that comprises opposed depending walls connected by a bottom surface and support flanges extend away from the opposed depending walls, and wherein the refrigeration storage insert removably engages the opposed side walls of the drawer frame respectively with the support flanges and the depending walls extend interior of the drawer frame such that the bottom surface is supported at a position extending underneath the divider.

2. The refrigeration apparatus of claim 1, further comprising:
- a pair of fixed rails secured to the interior of the refrigeration cabinet; and
- at least one pair of movable rails secured to the opposed side walls of the drawer frame.

3. The refrigeration apparatus of claim 2, wherein the at least one pair of movable rails further comprise inwardly extending support brackets and the inwardly extending support brackets are secured to respective bottom ends of the opposed side walls.

4. The refrigeration apparatus of claim 3, wherein the opposed depending walls of the refrigeration storage insert extend through the drawer frame past the at least one pair of movable rails, and the bottom surface is located at a position below the at least one pair of movable rails.

5. The refrigeration apparatus of claim 1, further comprising:
- a front frame ledge extending interior of the drawer frame from the front wall, the front frame ledge comprising a plurality of divider apertures; and
- a rear frame ledge extending interior of the drawer frame from the rear wall, the rear frame ledge comprising a plurality of divider apertures.

6. The refrigeration apparatus of claim 5, further comprising a plurality of dividers removably extending across the drawer frame between the divider apertures of the front wall and the divider apertures of the rear wall, wherein the plurality of dividers comprises the divider.

7. The refrigeration apparatus of claim 5, further comprising side frame ledges extending interior of the drawer frame from the opposed side walls, wherein the support flanges of the refrigeration storage insert engage the side frame ledges.

8. The refrigeration apparatus of claim 7, further comprising downwardly depending lips that extend from the support flanges.

9. The refrigeration apparatus of claim 8, wherein when the support flanges engage the side frame ledges, the downwardly depending lips engage respective exterior surfaces of the opposed side walls.

10. The refrigeration apparatus of claim 5, wherein when the support flanges engage the opposed side walls, the support flanges are co-planar with the front frame ledge and the rear frame ledge.

11. The refrigeration apparatus of claim 1, wherein the opposed depending walls of the refrigeration storage insert extend below the walls of the drawer frame and the bottom surface is located at a position below a bottom of the drawer frame.

12. The refrigeration apparatus of claim 1, wherein the refrigeration storage insert removably engages the drawer frame free from engagement with the front wall and the back wall of the drawer frame.

13. The refrigeration apparatus of claim 1, further comprising at least one storage pan removably supported by the drawer frame by engagement of the at least one storage pan with at least the front wall and the rear wall at a position with a bottom of the at least one storage pan suspended vertically above the bottom surface.

14. The refrigeration apparatus of claim 13, wherein the at least one storage pan is a first storage pan and the bottom surface supports a second storage pan at a position underneath the first storage pan.

15. The refrigeration apparatus of claim 13, wherein the at least one storage pan is removably supported by the drawer frame free from engagement with the refrigeration storage insert.

16. The refrigeration apparatus of claim 13, wherein the at least one storage pan is further removably supported by engagement with the divider and at least one of the support flanges of the refrigeration storage insert.

17. The refrigeration apparatus of claim 1 wherein the refrigeration storage insert is constructed of a single piece of sheet metal.

18. The refrigeration apparatus of claim 1, further comprising:

a front ridge extending along a front edge of the bottom surface; and a back ridge extending along a back edge of the bottom surface.

19. The refrigeration apparatus of claim 18, wherein the front ridge extends along front edges of the depending walls and the back ridge extends along back edges of the depending walls.

20. A refrigeration apparatus comprising:

a refrigeration cabinet, wherein the refrigeration apparatus is configured to control an environmental condition within the refrigeration cabinet;

a drawer frame comprising a front wall, a rear wall, and opposed side walls;

a door secured to the front wall of the drawer frame;

a divider extending across the drawer frame between the front wall and the rear wall; and a refrigeration storage insert that comprises opposed depending walls connected by a bottom surface and support flanges extend away from the opposed depending walls, a front ridge extends along a front edge of the bottom surface, and a back ridge extends along a back edge of the bottom surface;

wherein the refrigeration storage insert removably engages the opposed side walls of the drawer frame respectively with the support flanges and the depending walls extend interior of the drawer frame such that the bottom surface is supported at a position below the divider and the front ridge and the back ridge terminate at a position below a bottom of the drawer frame.

21. A refrigeration apparatus comprising:

a refrigeration cabinet, wherein the refrigeration apparatus is configured to control an environmental condition within the refrigeration cabinet;

a drawer frame comprising a front wall, a rear wall, and opposed side walls;

a front frame ledge extending interior of the drawer frame from the front wall, the front frame ledge comprising a plurality of divider apertures;

a rear frame ledge extending interior of the drawer frame from the rear wall, the rear frame ledge comprising a plurality of divider apertures;

a door secured to the front wall of the drawer frame;

a divider extending across the drawer frame between a divider aperture of the front wall and a divider aperture of the rear wall; and a refrigeration storage insert that comprises opposed depending walls connected by a bottom surface and support flanges extend away from the opposed depending walls;

wherein the refrigeration storage insert removably engages the opposed side walls of the drawer frame respectively with the support flanges co-planar with the divider extending across the drawer frame between the divider aperture of the front wall and the divider aperture of the rear wall, and the depending walls extend interior of the drawer frame such that the bottom surface is supported at a position below the divider.

* * * * *